United States Patent [19]

Godlewski

[11] Patent Number: 5,000,435

[45] Date of Patent: Mar. 19, 1991

[54] ADJUSTABLE INTERCONNECTED DELIVERY AND DISCHARGE CONVEYOR WITH FEED CONTROL

[76] Inventor: Edward S. Godlewski, 129 S. Spruce St., Wooddale, Ill. 60691

[21] Appl. No.: 232,104

[22] Filed: Aug. 15, 1988

[51] Int. Cl.[5] ..... B65H 5/00

[52] U.S. Cl. ..... 271/10; 271/116; 271/126; 271/149; 271/153; 271/150; 271/155; 271/162; 198/592; 414/924; 414/926

[58] Field of Search ..... 271/3, 3.1, 4, 6, 7, 271/10, 31.1, 110, 111, 113, 114, 116, 117, 119, 121, 124, 125, 126, 225, 258, 265, 147, 149, 150, 151, 152, 153, 154, 155, 156, 162, 167, 184, 185, 34, 35; 198/592; 414/924, 926; 29/116.1, 116.2, 129; 16/18 R, 30, 45, 38, 46

[56] References Cited

U.S. PATENT DOCUMENTS

| | | | |
|---|---|---|---|
| 1,033,968 | 7/1912 | Waldron . | |
| 1,063,336 | 6/1913 | Duncan | 271/116 X |
| 1,365,534 | 1/1921 | Neihart | 271/126 |
| 2,715,975 | 8/1955 | Doane et al. . | |
| 2,956,801 | 10/1960 | Coakley . | |
| 3,598,399 | 8/1971 | Cottrell | 271/149 X |
| 3,777,903 | 12/1973 | Kuckhermann . | |
| 3,830,144 | 8/1974 | Kuckhermann et al. . | |
| 3,894,732 | 7/1975 | Müller | 271/10 |

FOREIGN PATENT DOCUMENTS

| | | | |
|---|---|---|---|
| 269829 | 11/1987 | Japan | 271/150 |
| 57441 | 3/1988 | Japan | 271/119 |

*Primary Examiner*—David H. Bollinger
*Attorney, Agent, or Firm*—John J. Kowalik

[57] ABSTRACT

A conveying system comprising two conveyors interconnected for adjustment relative to each other and an arrangement of rollers some of which convey and during a set period others serve as drag against the stock items carried thereon to obtain single item feeding.

17 Claims, 10 Drawing Sheets

FIG. 12
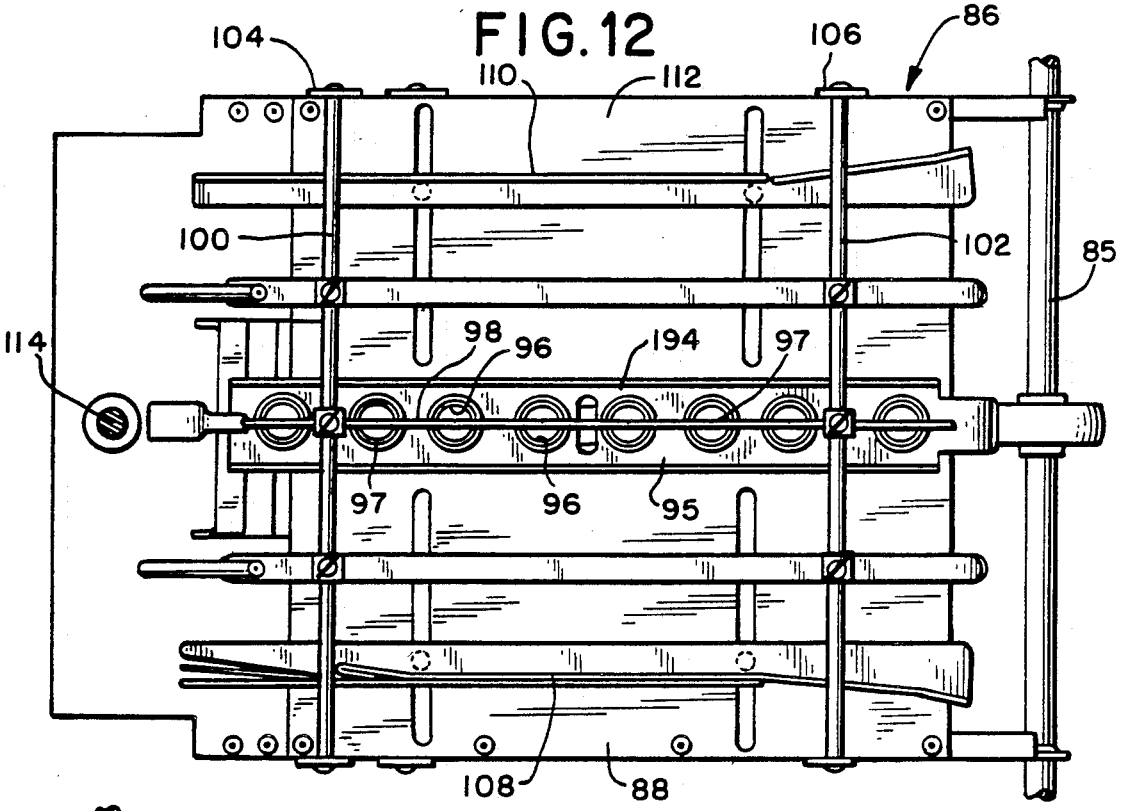
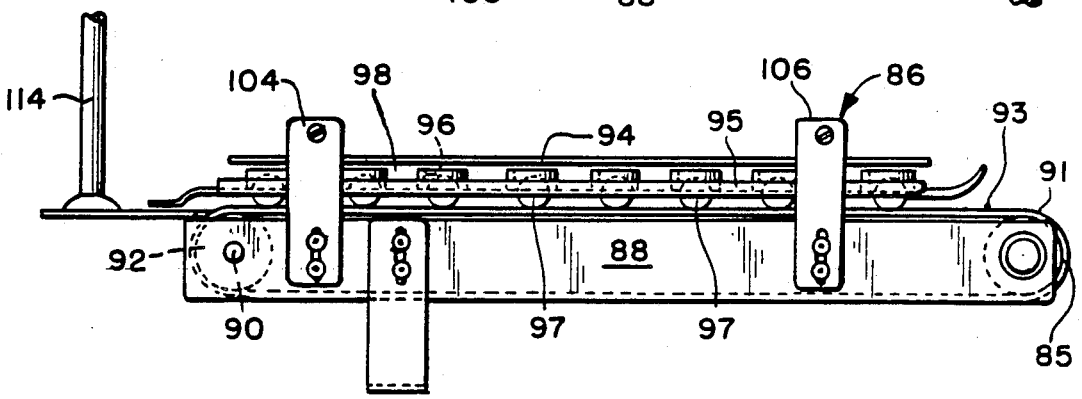
FIG. 13

FIG.14
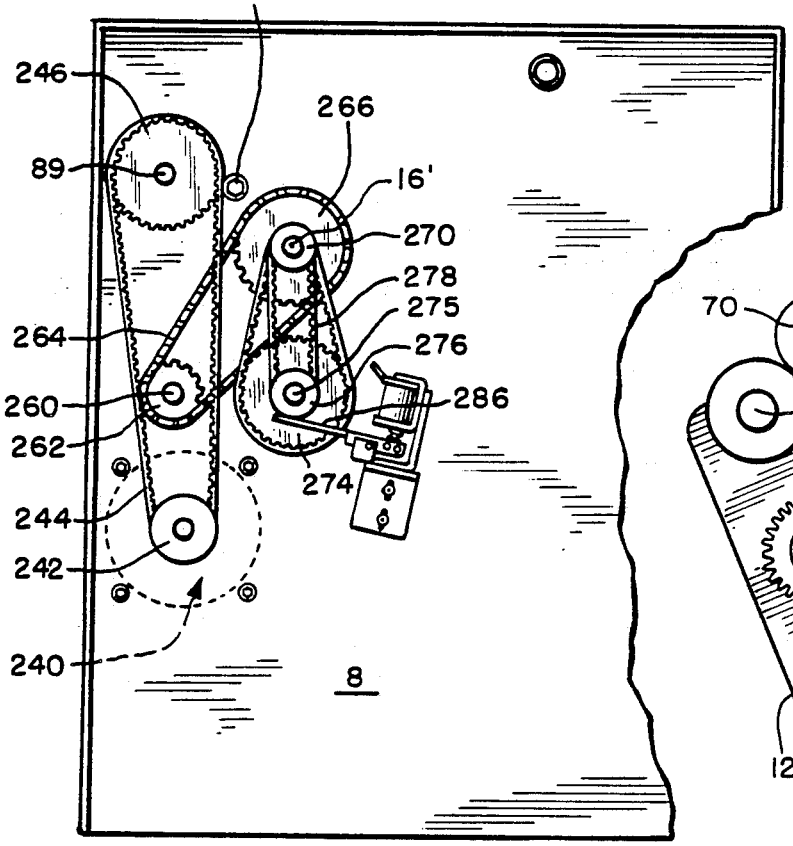
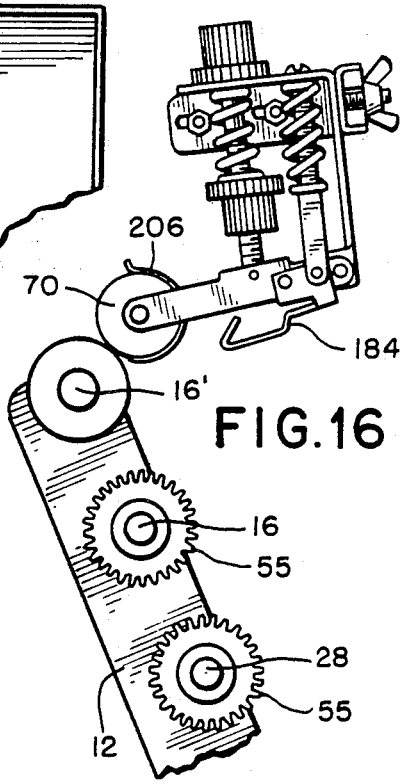
FIG.16
FIG.15
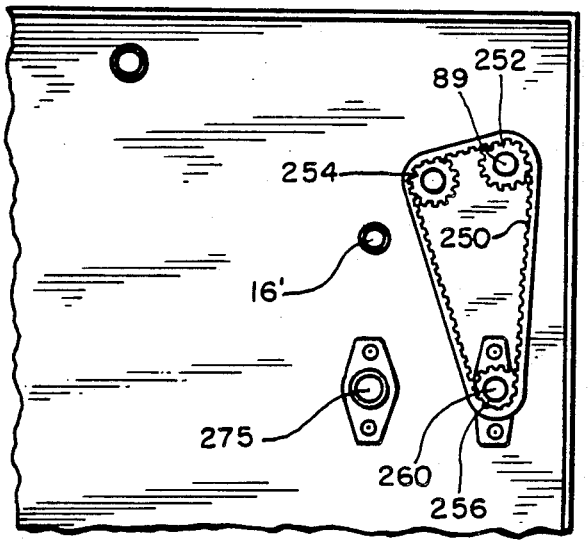
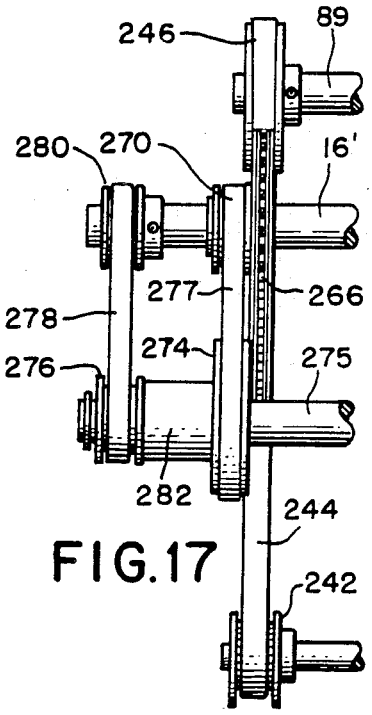
FIG.17

ADJUSTABLE INTERCONNECTED DELIVERY AND DISCHARGE CONVEYOR WITH FEED CONTROL

BACKGROUND OF THE INVENTION

This invention is an improvement on the structure shown in the companion U.S. patent application Ser. No. 07/125,973 entitled Upfeed Conveyor System filed Nov. 27, 1987.

This invention relates to conveyors for sequentially feeding stock items such as paper, of various grades, different types of envelopes, booklets, stuffed envelopes and the like without the necessity of making any or minimal adjustments.

SUMMARY OF THE INVENTION

This invention relates to a conveyor system wherein stock items are conveyed sideways by an infeed conveyor and laid at one end against an upfeed conveyor.

As explained in the previous application, the lateral or infeed conveyor is pivoted at its discharge end whereat it feeds the stock to the upfeed conveyor and is adapted to be raised in toto as it is tilted upwardly at its intake end. In this embodiment of the invention the infeed conveyor as it is manually raised it is so connected to the upfeed conveyor which is pivoted at it upper end, as to automatically swing the upfeed conveyor about a horizontal axis toward the adjacent discharge end of the infeed conveyor and thereby maintain the upfeed conveyor at a predetermined desired angle thereto so that the items being fed sideways from the infeed conveyor will under usual feed conditions lie flat against the infeed conveyor and not be tilted at their upper ends, toward the infeed conveyor, provision being made for the plane of each article or items to be positioned at a small acute angle to the plane of the infeed conveyor or generally parallel therewith for various stock feeding.

The invention also contemplates a novel upfeed conveyor which comprises an elongated hollow spine which contains all of the drives to a plurality of transverse shafts spaced longitudinally of the spine and parallel thereon. The spine is pivoted at its discharge end on a main drive shaft which is positioned in a pair of side walls of the unit. All of the other shafts are positioned between the side walls spaced at their ends from the respective side wall so that the ends of these shafts are accessible to the operators from the upper side of the unit.

Each shaft has several rollers sleeved thereon which are mounted on the shafts through one way roller bearing clutches. The rollers on the drive shaft are operated through the clutches to overrun the shaft and the rollers on the several of the other shafts are inverted so that they may rotate freely counter to the powered rotation of the respective shaft and only rotate in the direction that the shaft is driven, when its shaft is stopped the roller thereon serves as a drag against the item engaged thereby. Thus when the first item at the end of a stack is being fed to a metering device, the next or second in line item is exposed at it trailing end to the rollers remote from the discharge and of the upfeed conveyor. Thus the stationary roller restrain the second item from being dragged through to the metering device with the first item by the frictional engagement between the first and second items.

A primary object is to provide a novel automatic system for adjusting the upfeed conveyor with the infeed conveyor as the latter is lifted or lowered to accept stocks of different dimensions and characteristics.

Another primary object is to provide a conveyor with a spine which has a series of substantially identical rollers mounted on parallel shafts spaced lengthwise of the upfeed conveyor, the rollers being each connected through one way clutch to its respective shaft and the rollers adjacent to the discharge end of the upfeed conveyor being rotatable to overrun their shafts, whereby the rollers adjacent to the trailing end of the conveyor are reversely mounted on their respective shafts so as to act as drags when their shafts are stopped and are operative to engage the trailing end of the items being next presented thereto upon being uncovered by the preceding items which is being pulled by pull-out draft rollers from the stack of items carried by the infeed conveyor.

A further object is to provide novel rollers which in one position on the shaft are rotatable in the direction of the feed of the stock items and which when inverted serve as a drag so that the item engaged thereby is restrained from being simultaneously pulled into feeding mechanism.

These and other objects and advantages inherent in an encompassed by the invention will become more apparent from the specification and drawings, wherein.

DESCRIPTION OF THE DRAWINGS:

FIG. 12 is a top view of the table conveyor;

FIG. 13 is a side elevational view of the tables conveyor;

FIG. 14 is a side elevation of one side of the unit;

FIG. 15 is the opposite side view of the unit;

FIG. 16 is fragmentary enlarged cross-section of an upper position the upfeed conveyor and retard assembly;

FIG. 17 show a position of a drive from the clutch.

FIG. 19 being an exploded view;

FIG. 20 being an edge view of the hub assembly, and

FIG. 21 is a cross-section of the roller.

DESCRIPTION OF THE INVENTION

Figure 1:
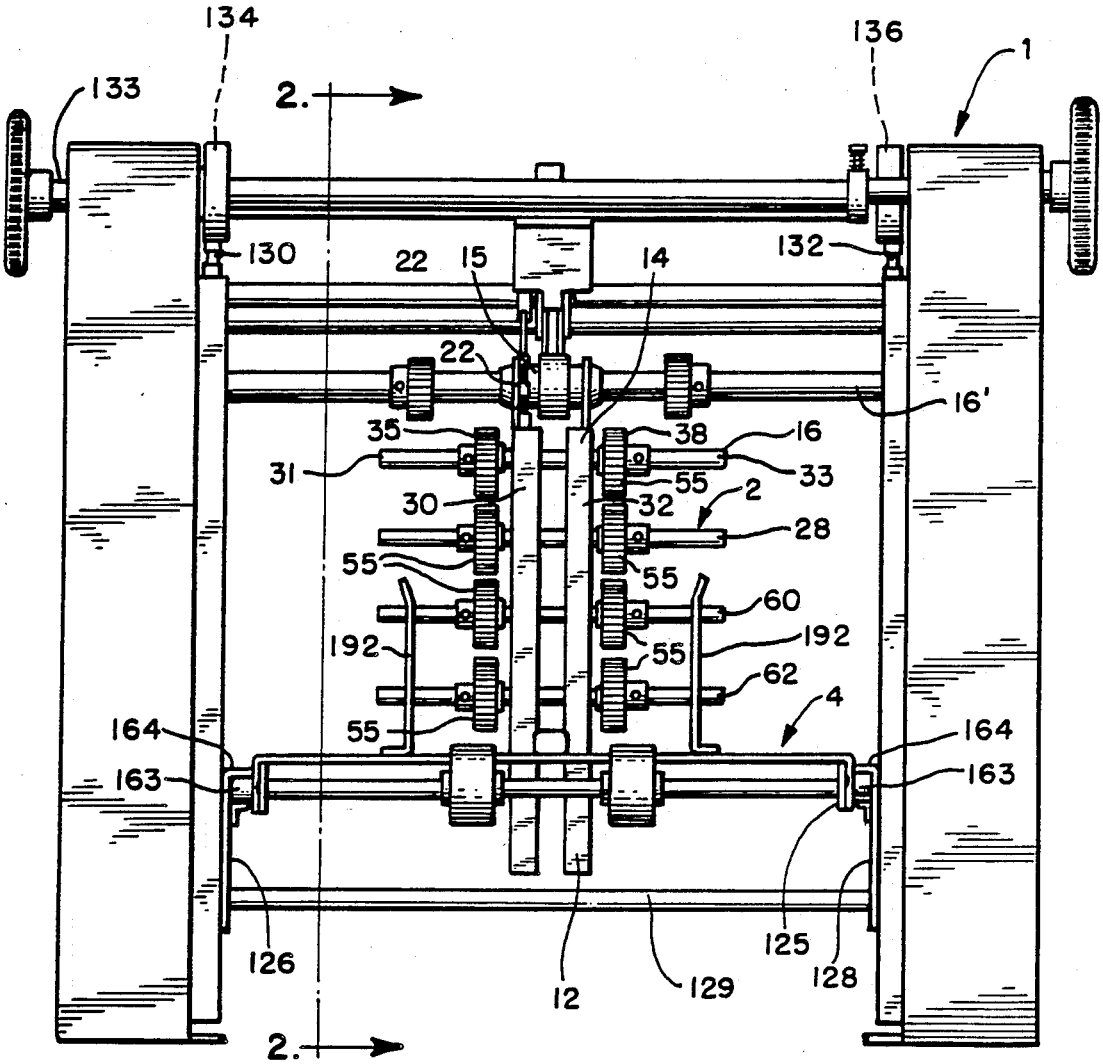
FIG. 1 is a front view of the conveyor.

Referring to the drawings the feeding mechanism generally designated, 1 comprises an upfeed or delivery conveyor 2 and an infeed or supply conveyor 4 which extends transversely to conveyor 2.

The feeder unit comprises a housing having upright side wall 8, 10.

The upfeed conveyor comprises a spine element 12 of hollow tubular construction having it upper end 14 provided with bearing 15 journaling a transverse drive shaft 16 at the discharge end of the upfeed conveyor. The shaft 16 extends at its opposite end through journal bearing 18 and 20 in the side walls 8 and 10.

Within the tubular spine the drive shaft 16 is keyed or connected by a screw to a sprocket 22 which drives a chain 24 trained about a sprocket 26 connected to a transverse shaft 28 journaled in bearings on the side walls 30, 32, of the spine and spaced below shaft 16 longitudinally of the spine. Shaft 28 is shorter than the distance between the side wall of the housing and has its ends 31, 33 spaced inwardly from the side walls of the housing to provide access space between the ends of the shafts and having walls for the operator to insert rollers 35, 38 onto the shaft 28.

Each roller has a preferably metal mounting sleeve portion 36 which is fitted with a series of wedge rollers 29 adapted to ride on shaft 28 upon insertion of the sleeve 36 with roller therein onto its associated shaft. The hub is press fitted within bore 39 in a preferably plastic sleeve 40 and engages at its inner end the outer side of an annular flanges 42 provided on the inner end of axially extending second sleeve 44 which fits over the associated shaft 28. The inner face 45 of sleeve flange 44 engages an inturned annular flange 46 at an adjacent end of sleeve 40. Flange 46 has a circular aperture 48 through which extends the sleeve 44.

A preferably metal ring 47 is fitted about the periphery of the sleeve 44 and is provided with a set screw 50 which is threaded through a threaded opening 52. Screw 50 has an inner end 54 which engages a portion of the sleeve 44 and attendant to being threaded into the aperture 52 deflects the adjacent portion of sleeve 44, which may be made of nylon or similar flexible plastic material, against the associated shaft whereby locking the roller to the shaft.

A roller disk 55 made of flexible material such as polyurethane and the like has a center aperture 56 which is tightly sleeved onto the sleeve 40. The disk has its outer periphery formed with a plurality of circumferentially spaced axially elongated ribs 58 which engages articles presented thereto. The roller disk 55 sleeve 40 and the clutch bearing assembly 29 are rotatably interlocked with the extension sleeve 44.

The spine or support is provided with at least two other cross shafts 60, 62 spaced from each other and from the shaft 28 and each is journaled in bearing in the side walls of the spine substantially parallel to the other shafts. Shaft 60 is driven by a sprocket and chain arrangement 64 extending between shaft 28 and shaft 60 and shaft 62 is similarly driven by a chain and sprocket assembly 66 operatively connected to shafts 60 and 62.

However, the roller assemblies on shafts 60, 62 are reversely mounted to the shafts 60, 62 with respect to those mounted on shafts 16 and 28.

Figure 5:
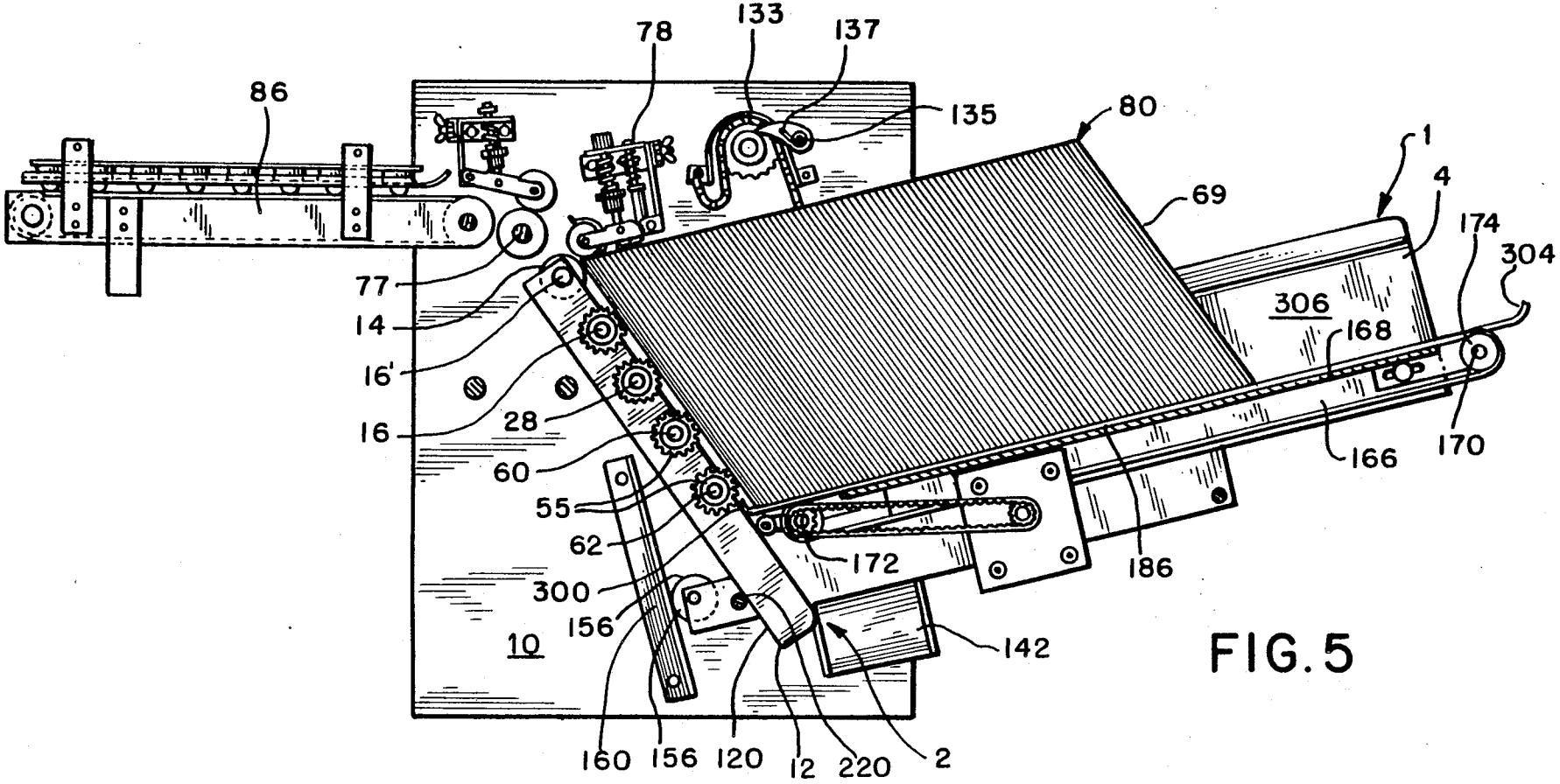
FIG. 5 is a view similar to FIG. 4 showing the bottom portions of the stock pulled away from the lower rollers.
Figure 5A:
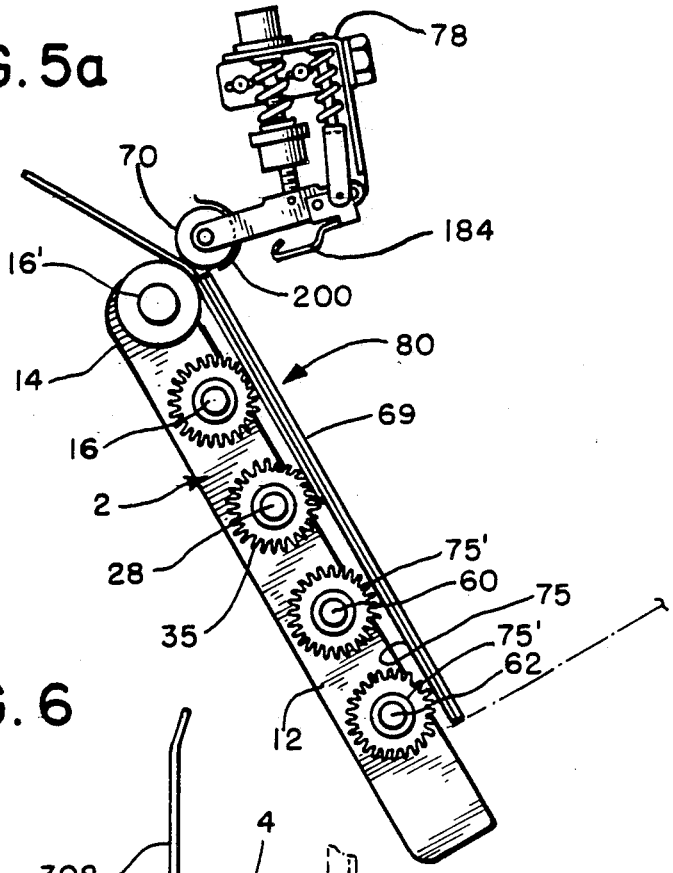
FIG. 5*a* shows the overlap of items on the upfeed conveyor.
Figure 6:
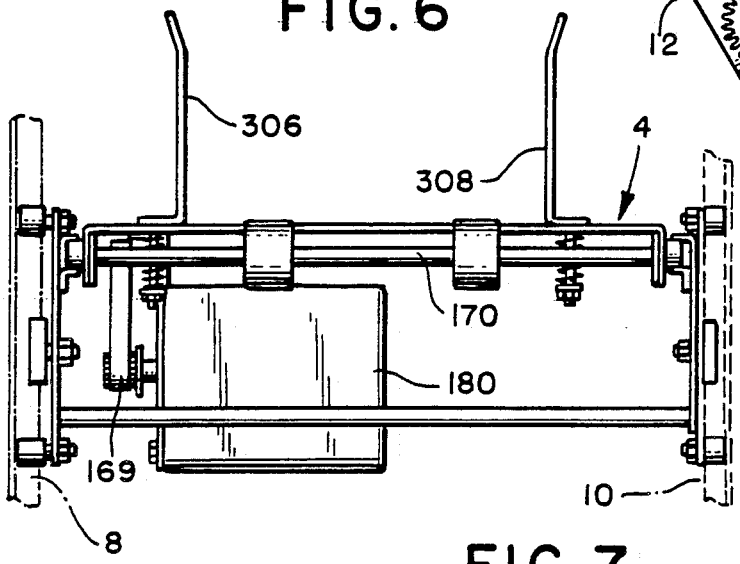
FIG. 6 is a rear end view of the infeed conveyor.
Figure 7:
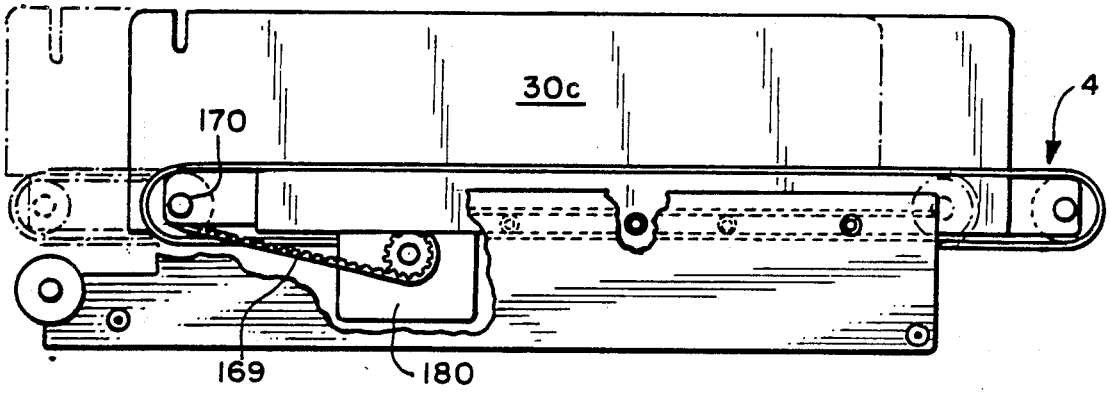
FIG. 7 is a side elevation of the infeed conveyors parts being broken away to move clearly show the construction.
Figure 8:
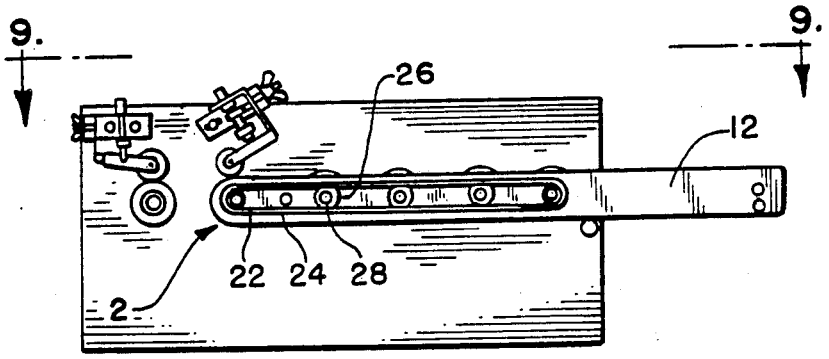
FIG. 8 is a cross-sectional view of the upfeed conveyor taken substantially on line 8—8 of FIG. 9.
Figure 9:
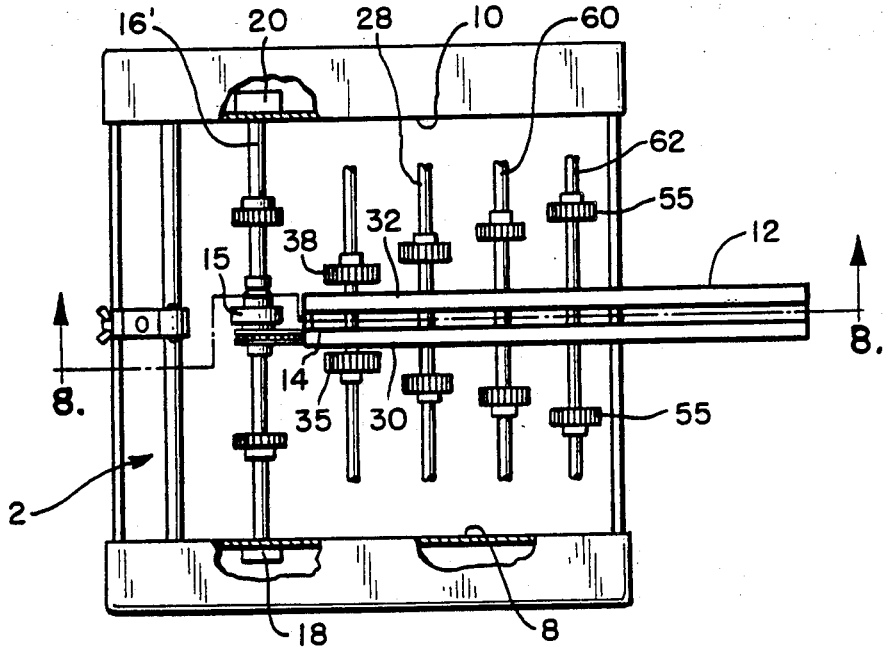
FIG. 9 is a top plan view of the upfeed conveyor.
Figure 10:
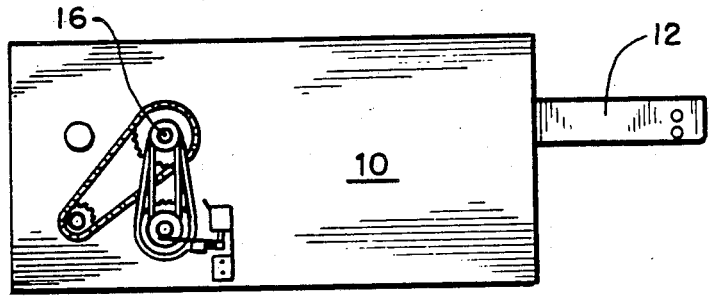
FIG. 10 is a side elevational view of one side of the unit showing a drive.
Figure 11:
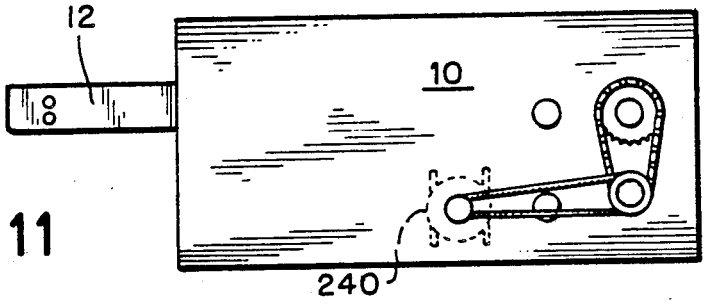
FIG. 11 is an opposite side view showing the drive on that side.
Figure 18:
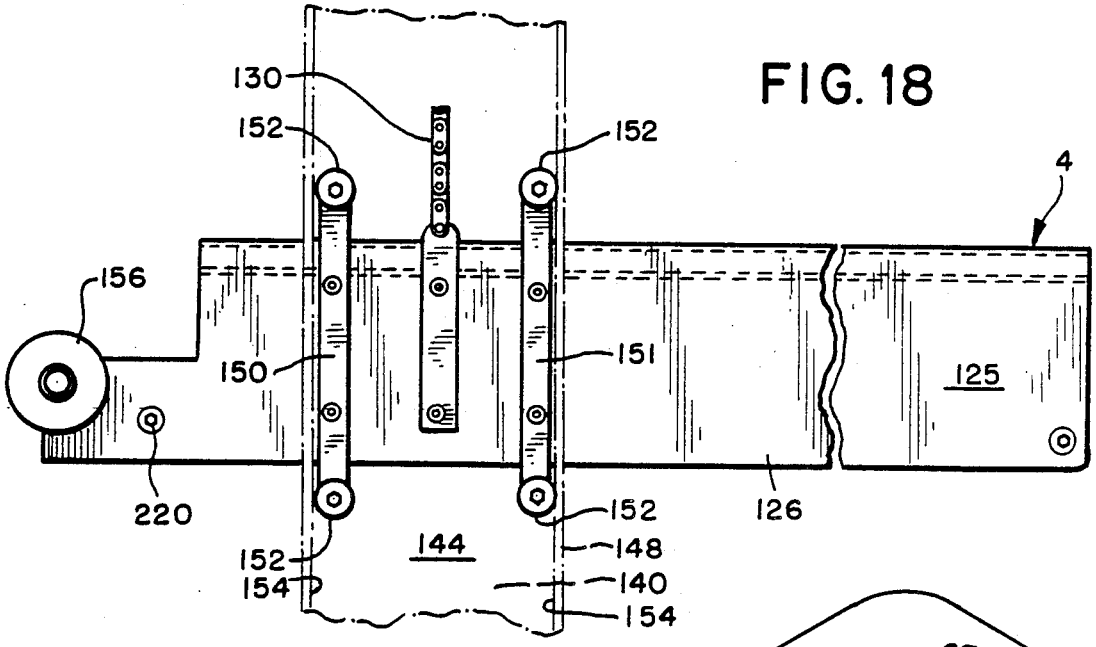
FIG. 18 is an enlarged side view of the infeed conveyor and mounting therefor.
Figure 19:
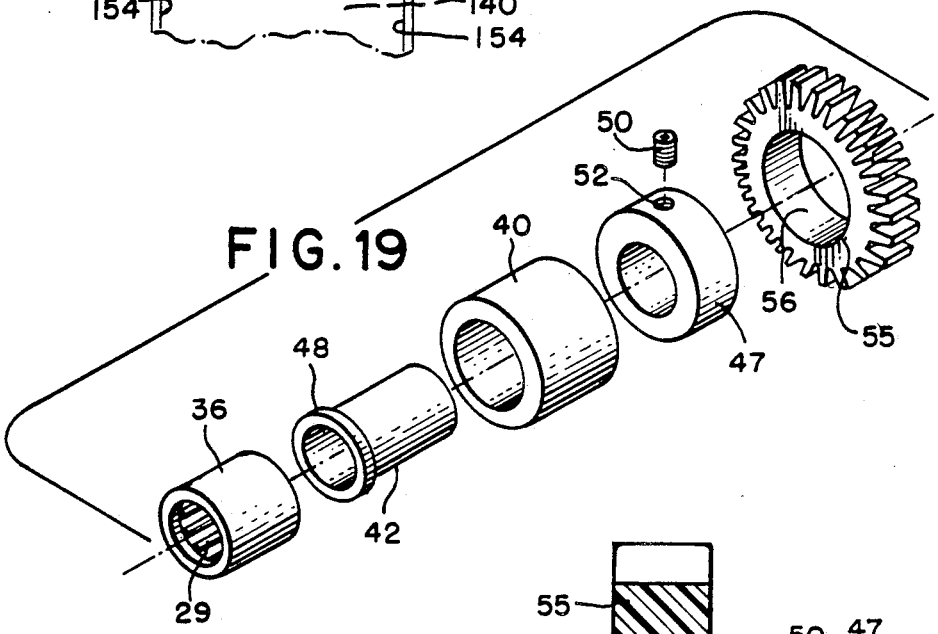
FIGS. 19–21 show the construction of the rollers.
Figure 20:
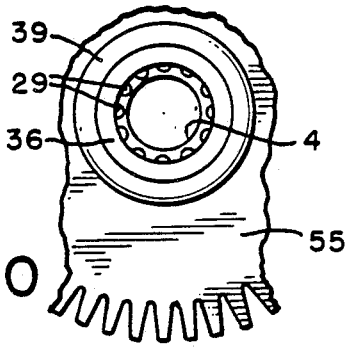
Figure 21:
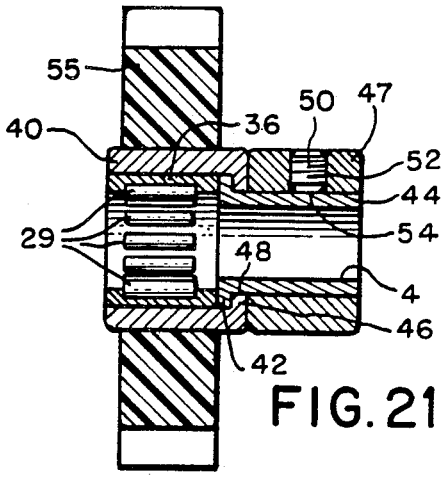

The rollers on shafts 16 and 28 are driven rollers in that they are locked in the manner of overrunning their clutch bearings attendant to shaft 16 being power driven whereas the roller on the shafts 60 and 62 are reversely mounted with respect to the rollers on shafts 16 and 28 and will only rotate with their respective shafts attendant to shaft 16 being driven a half turn. Thereafter as the article or items 69 which is initially in engagement with all of the rollers and is pulled from the end of the stack and fed to the metering assembly 70 and into the pull-out rollers 77, 77 is moved off the rollers on the shafts 60, 62, the drive to the shaft 16 ceases and the roller on the shafts 16, 28 overrun the 16, 28 shafts and allow the stock item to continue its discharge as it is being pulled by the pull-out rollers. In the meantime the next item overlying the item being pulled has it trailing end portion 75' engaged with the rollers on the shafts 60, 62 which provide means engagable with the stack for positioning the trailing portion in engagement with portions of the upfeed conveyor. These rollers cannot rotate in a delivery direction because they are reversely mounted and thus are stationary and engage the next or succeeding items as at 75' as seen in FIG. 5*a*. The rollers on shafts 60, 62 serve as drags. These rollers on shafts 60, 62 may be fixed through other means to these shafts to rotate only when these shafts rotate. However in such case flexibility is lost in that if a longer stock item is to be fed it may be desirable to reverse the roller mounting on shaft 60 so that they may overrun shaft 60.

The upper discharge rollers 35 on shaft 16' cooperates with a retard disk or cylinder 70 which is mounted on an adjuster 78 as discussed in the previous referenced embodiment and the description therein is hereby incorporated herein and is identical therewith.

It will be noted that upon delivery of the leading end of the first item 69 of the stack of items generally designated 80, to the metering device, and the leading end is forced through the nip 82 between the retard and the roller 35 on the drive shaft 16' which at this time is in the drive mode will cause the leading end of the item to enter and be positively grasped by the continuously driven pull-out rollers 77, which deliver to the intake end 85 of a horizontal delivery conveyor 86 as seen in FIG. 12.

The delivery conveyor 86 comprises an elongated frame 88 which journals at its ends shafts 89, 90 having cylindrical rollers 91 and 92 mounted thereon. Belts 93 are trained about rollers 91, 92 and support the stock items 69 as they are delivered thereto. The intake end of conveyor 86 is positioned at the discharge of the pull-out rollers and supported by roller shaft 89, journaled in the side sheets 8, 10 of the housing.

The items enter between the belts 93 and an overlying guide or hold down 94 which comprises a longitudinal holder 95 having a series of vertical sockets 96 with balls 97 therein projecting below the holder for engaging the upper side of the items 69 therewith. The balls are held captive in the sockets by a wire 98 removably secured at each end to cross-supports 100, 102 mounted transversely of the delivery conveyor and secured at opposite ends to upstanding side flanges 104, 106. The lateral guides 108, 110 are adjustably secured to a base on the bottom wall 112 of the delivery conveyor frame 86.

The discharge end of the delivery conveyor delivers to the press-feeders as well known and herein represented as a suction finger 114.

As best seen in FIGS. 1, 2, 5 and 18 the infeed conveyor 4 comprises a tray or cradle 125 which has a pair of side walls 126, 128 and a bottom wall 129. The side walls 126, 128 are connected to lifting and lowering cables, chains or links 130, 132 which are draped at their upper ends over sprockets 134, 136 secured to a transverse shaft 133 of an adjusting mechanism 135. A ratchet pawl 137 is secured at 138 to one of the side walls of the support.

A pair of pendular arms of links 140, 142 are pivoted co-axially at their upper ends from the side walls 8 and 10. Each arm is U-shaped in cross-section having a base wall 144 and a pair of flanges 146, 148 in parallel arrangement.

Figure 2:
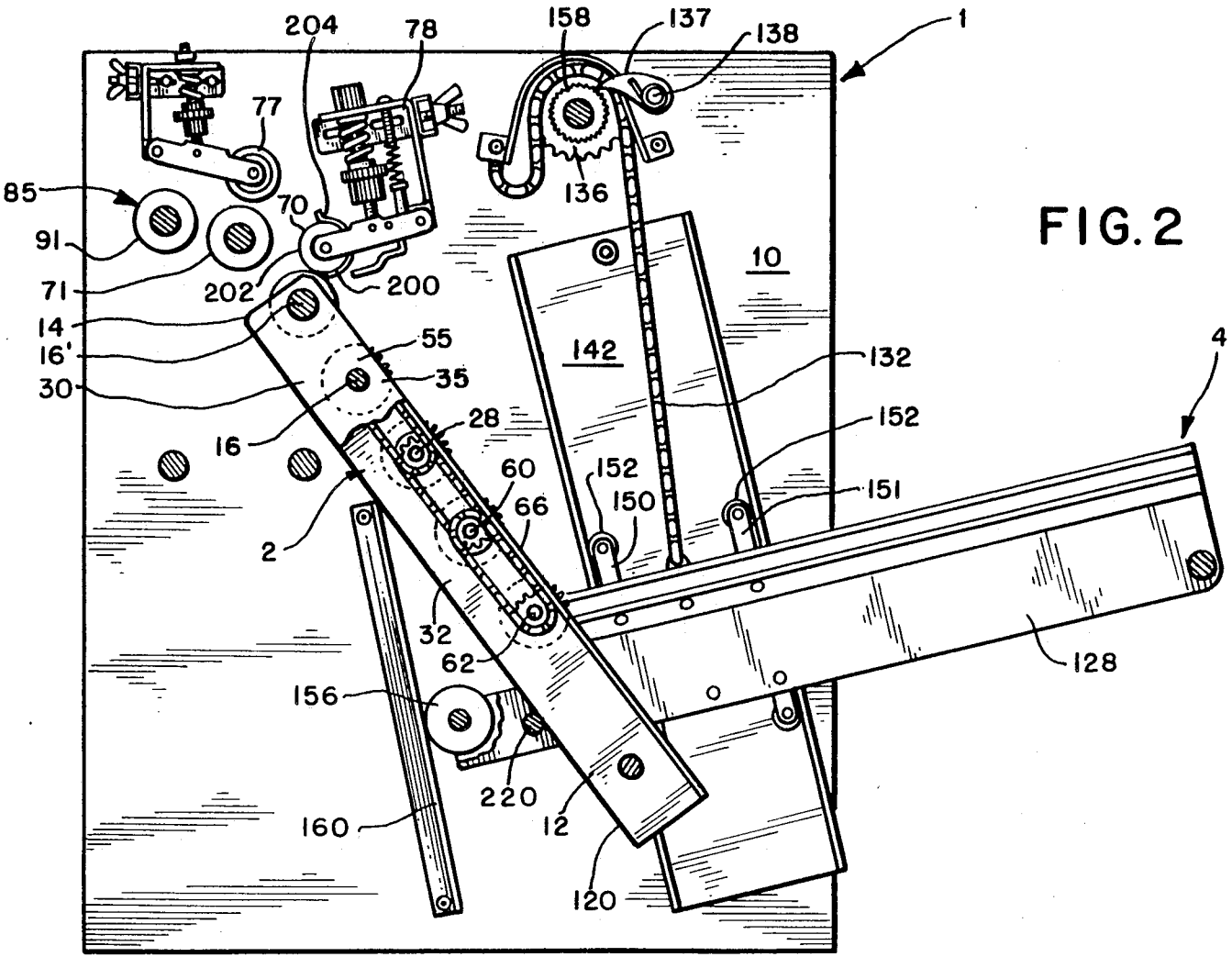
FIG. 2 is a cross sectional view partly broken away taken substantially on line 2—2 of FIG. 1 showing the conveyors in lowered position.
Figure 3:
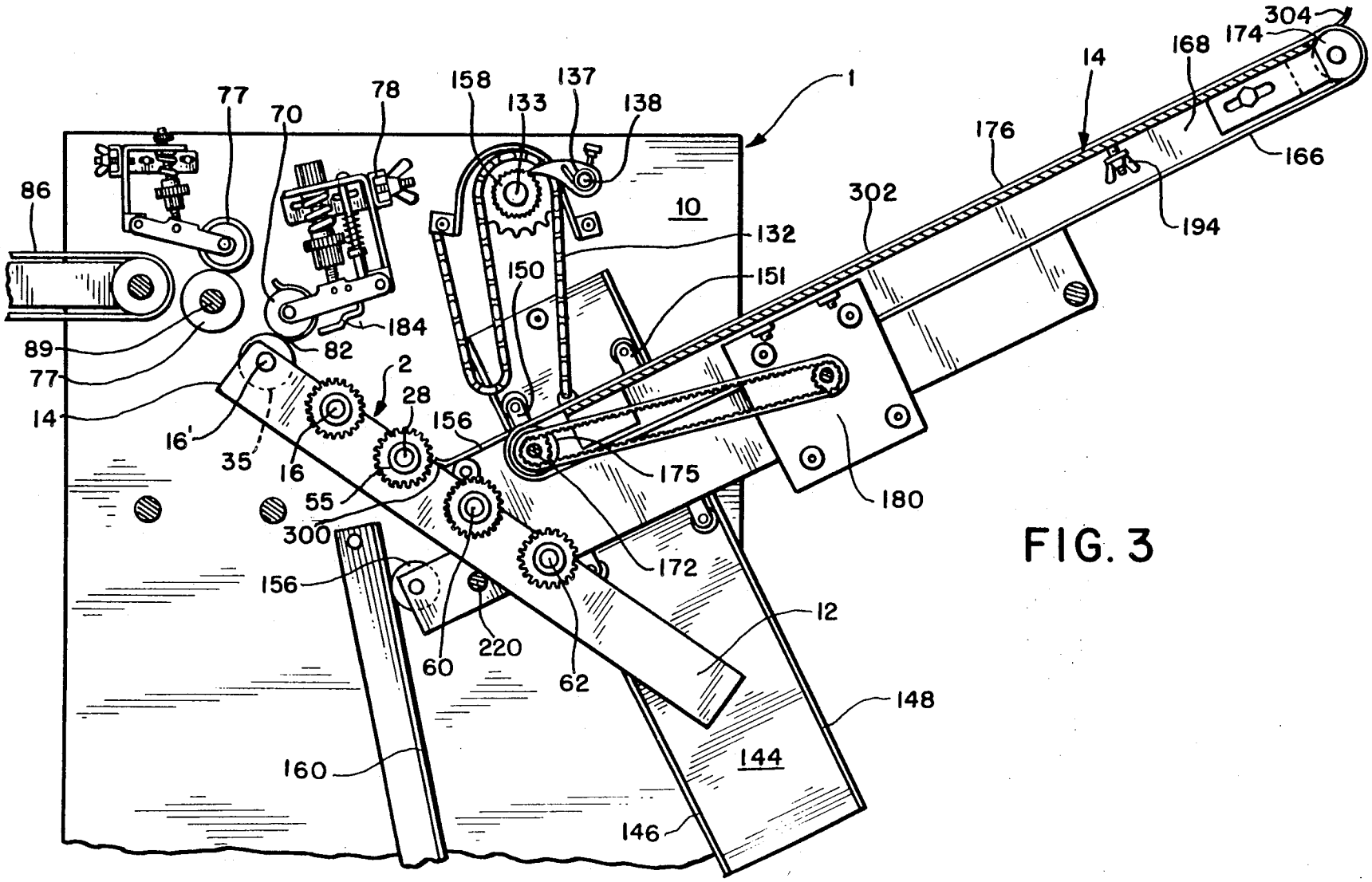
FIG. 3 is a view similar to FIG. 2 showing the conveyors in upper position.

The tray has at each side thereof a pair of parallel upright guides or trolleys 150, 151 mounted on the side walls thereof as seen in FIG. 2 and the guides are provided on their upper and lower ends with rollers or wheels 152, 152 which ride along the interior sides 154, 154 of the flanges. Thus as the tray is lifted or lowered as the ratchet 158 is engaged or disengaged the guide wheels 152 ride up and down within the respective arms and are held in adjusted position by the ratchet.

The tray is provided on its forward end with a roller 156 adjacent to each side thereof rotatable on transverse axes along parallel coplanar or transversely aligned tracks 160 mounted on side walls 8 and 10. It will be noted that the position of the axis of pivot of the hangers determines that the tray will be biased toward the tracks and that as seen in FIG. 2 the lower that the tray is located the more horizontally it is positioned and the higher the more slanted. That is the angle of delivery from the tray to the upfeed conveyor is more when the articles are small than when they are large. Thus the load exerted by the items both small and large against the upfeed conveyor is essentially the same.

For automatically tilting the tray to desired position, the track at each side of therewith is angled upwardly and converges toward the back side of the upfeed conveyor.

The tray has rollers 163, 163 at each side riding in tracks 164, 164 sloped toward the upfeed conveyor and being rotationally biased by gravity toward the upfeed conveyor and engaging its rollers 156 with tracks 160.

The tray mounts a conveyor 166 therein comprising a longitudinal frame 168 which at opposite ends mounts on parallel shafts 170, 172 pulleys 174, 175 mounting belts 176. The belts are driven from an electric motor 180 carried by the frame 168 by a belt and pulley drive 169 to the shaft 170. The motor is suitably connected in a circuit through a switch 184 which is engaged by the end 46 of the stack when the conveyor is full or the supply is adequate. The stack is seated at one edge 186 on a carrier belt or belts 176. As the stack is depleted the switch 184 moves to an "on" position which completes the circuit though the motor 180 causing the motor to run and the belts to advance stock to the upfeed conveyor. When the stock engages the switch the motor is turned "off". The stock is shown in FIG. 5 and the upper end of the upper portion of an item is shown disengaging the switch. The stock engages adjacent to each lateral edge thereof with an upright guide 192 flanking the stock. The guides 192 are adjustably mounted on the frame of the carrier or cradle and secured thereto by wing bolt and nut assemblies 194 to adjust for the width of the particular item being conveyed. It will be noted that the guides 192 are adjustable longitudinally and also laterally within respective slot in the bottom tray.

Figure 4:
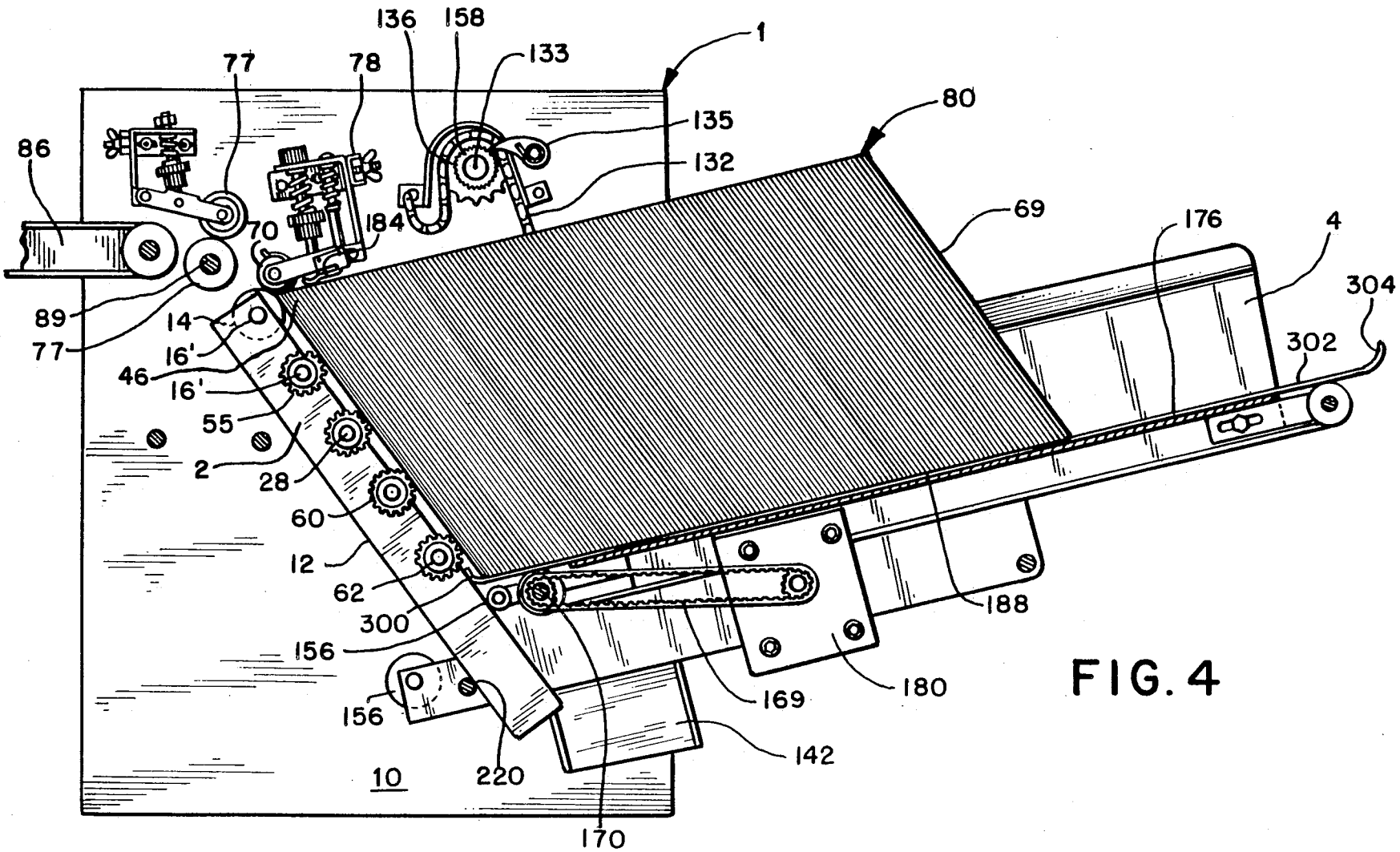
FIG. 4 is a view similar to FIG. 2 and 3 showing a load of stock items on the infeed conveyor, the stock laying on all of the rollers.

It will be apparent that the infeed conveyor may be easily disconnected or connected with the carrier or cradle and is adjustable toward and away from the upfeed conveyor to move to the positions shown in FIG. 2 and 4 in particular.

The motor 180 is suitably connected in circuit through a switch 184 which is engaged by an upper edge of the stock of items when the conveyor is full or the supply is adequate. As the stack is depleted the switch 184 is free of the stock and closes to actuated the drive to deliver to the stock to the upfeed conveyor.

To control and insure feeding single items through the retard 70, the retard is made of material having a high coefficient of friction. I have found that in this feeder the section of the retard presented to the items being fed must be limited. Otherwise the items engaging this pre-nip area will hang up and resist entering the metering nip. In order to control the extent of the pre-nip area there is provided a shield 200 (FIGS. 2) in the form of an arcuate or C-shaped band wrapped about and embracing a major portion of the periphery 202 of the annular retard disk 70 and sphincterally embracing and biased toward the same. A radially projecting finger nib 204 is provided at one end of the shield which permits rotation of the shield about the periphery of the disk 70 to regulate the retard area to approximately the thickness of one item as seen in FIG. 5*a* wherein the following items engage the underside or exterior 206 of the shield, which is slick, and permits succeeding items to readily slide one by one into the retard and thence into the retard nip. If the pre-nip area is too large experience has shown that the stock will not feed or will either feed erratically.

Thus a novel and effective conveying system has been disclosed which is adapted to accommodate facile adjustment for items of various sizes, and also takes account that the infeed conveyor must be angled to the upfeed conveyor for different size items so as to obtain load vectors in the several positions to cause the items to bear adequately with substantially the same pressure against the upfeed conveyor. The spring steel or metal shield provides the necessary slippage for the stock to feed regularly into the metering nip.

In this improved arrangement the side rails of the in feed conveyor project to behind the upfeed conveyor and support an adjusting connecting bar 220 which engages with the back side 120 of the spine. As the infeed conveyor is lifted and lowered along the tracks, and moves in and out with respect to upfeed conveyor, the adjusting bar 220 will swing the spine upwardly or downwardly about shaft 16' to an adjusted position.

The drive to the various components begins with the electric motor 240 mounted on a side panel 8 which drives a cog pulley 242 about which there is trained a cog belt 244 driving a cog 246 connected to shaft 89 of the feed table drive. A chain 250 is trained about sprockets 252, 254 and 256 fastened on shafts 89, 258 and 260 respectively.

Shaft 258 mounts the lower pull-out roller 72 and shaft 260 extends to the opposite side through side 8 of the housing and drives a sprockets 262 which drives a chain 264 driving a free running sprocket 266 on shaft 16'.

Sprocket 266 is connected to pulleys 270 which drives belt 277 driving pulley 274 which rotates on stationary shaft 275.

Shaft 275 rotatably mounts pulley 276 which drives belt 278 driving pulley 280 which is fastened to shaft 16'. Shaft 275 mounts a clutch 282 which is operated by a solenoid through a finger 286 which is arcuate to demand clutching position by a signal from the associated press.

Upon the clutch being actuated, the shaft 275 will drive belt 278 which in turn drives pulley 280 driving shaft 16'.

As best seen in FIGS. 4 and 5 a stop 300 is provided on the conveyor 4 which is connected to a shank 302 slidably mounted on the frame 168. The shank extends outwardly of the frame and is provide at its outer end with a finger grip 304. The stop 300 is adapted to be pulled away from the conveyor 2 to displace the lower end of stock items 69 away from the rollers 55 on shafts 60, 62. This may be necessary because of the type of paper making items 69. They may be gloss finished, slippery, plasticized etc. and may not need retardation. On the other hand if the paper is rough textured matt not finished etc. wherein adjacent sheets tend to hank onto each other FIG. 5*a* the stop may be positioned as in FIG. 4 so that the sheets bear full face against all of the rollers.

Lateral guides 306, 308 are adjustably secured to the top wall of the frame 168 for guiding and engaging the lateral edges of the paper 69.

I claim:

1. A conveying system comprising an infeed conveyor and an upfeed conveyor disposed in receiving relation thereto, means mounting said upfeed conveyor for pivotal movement about a generally horizontal axis, means for guiding and positioning the infeed conveyor upwardly and downwardly and to and fro with respect to the upfeed conveyor, and means operatively interconnecting said conveyors for correlatively moving said upfeed conveyor in predetermined adjusted positions to selected positions of said infeed conveyor for maintaining a preadjusted relationship therebetween upon repositioning of the infeed conveyor, and said upfeed conveyor having an upper discharge end, said mounting means comprising a power shaft, rollers mounted on the power shaft for rotating therewith attendant to powered rotation thereof and overrunning said shaft upon its being stopped, said upfeed conveyor having at least one other drive shaft parallel with said first-mentioned shaft, rollers means mounted on said other shaft having a clutch connection therewith and rotatable with the other shaft attendant to rotation thereof and stopping rotation with stooping of said other shaft, and stock items supported on edge in a stack on said infeed conveyor and having one side facing said upfeed conveyor and movable by the infeed conveyor for engaging the end stock item in the stack with said upfeed conveyor, a removal mechanism associated with said upfeed conveyor, said rollers on said power shaft adapted to engage said end stock item to remove the same from the stack and present it to said removal mechanism, means for driving said power shaft for a period sufficient to move and present said end stock item at one end to said removal mechanism while displacing a trailing portion of the end item in a position exposing the next item in said stack to a portion of the upfeed conveyor having said driven shaft for engagement with rollers thereon, said rollers on the driven shaft when it has stopped rotation serving as drags frictionally engaging the exposed portion of said next item and resisting its being pulled along with the end item.

2. A conveyor for delivering individual stock items from the end of a stack positioned thereon comprising a spine member, a plurality of cross shafts extending through said spine member and rotatably mounted thereon and having free end portions projecting from opposite sides of the spine member, drive transfer means drivingly interconnecting said shafts, rollers having one way clutch means including hubs adapted to be sleeved upon said shafts via said free end portions, means for securing said rollers in selected positions on the respective shafts from axial displacement thereon, certain of said rollers being positioned with said one-way clutch means driving said certain rollers as the shafts are driven in a delivery direction of the stock items, and other of said rollers being mounted in a disposition opposite to said certain rollers and operative upon stopping of the associated shaft to stop and function as drags engaging an exposed portion of a following item after partial removal of the initial end item from the stack.

3. The invention according to claim 2 and each roller comprising a wedge roller assembly in the hub for mounting on an associated shaft, a sleeve encasing the hub and having an end portion with an inturned flange spaced from one end of the hub, a resilient roller disk mounted on the sleeve, an extension sleeve mounted on the related shaft and having an outturned flange positioned between said inturned flange and adjacent end of the hub for providing a rotatable connection therewith, and means nonrotatably removably securing said extension sleeve to the associated shaft.

4. The invention according to claim 3 wherein said extension sleeve is made from a flexible plastic.

5. The invention according to claim 4 and said extension sleeve wherein said flexible plastic is nylon.

6. The invention according to claim 2 and said free end portion portions free end portions providing access to the respective shafts accommodating insertion and removal and positioning of an associated roller thereon in a predetermined relation thereto

7. A conveyor system comprising an infeed conveyor adapted to support a stack of items on edge for sidewise delivery thereof, said infeed conveyor having a delivery end, an upfeed conveyor positioned in receiving relation to said infeed conveyor, and having an upper end and a front side facing the infeed conveyor and having a back side, means pivotally supporting said upfeed conveyor at its upper end on a horizontal axis accommodating said upfeed conveyor to move toward and away from said delivery end of the upfeed conveyor, means guidably mounting said infeed conveyor for vertical displacement for positioning said delivery end thereof along the length of the upfeed conveyor at selected locations intermediate the ends of said upfeed conveyor, means operatively interconnecting said infeed conveyor to said upfeed conveyor and engaging the back side thereof for automatically adjusting said upfeed conveyor with respect to the delivery end attendant to repositioning of said infeed conveyor.

8. The invention according to claim 7, and said interconnecting means comprising a pair of extensions on said infeed conveyor flanking said upfeed conveyor and extending therebehind, and an adjusting element interconnecting said extensions behind the upfeed conveyor and engagable with the back side thereof for moving the upfeed conveyor toward and away from said delivery end as said infeed conveyor is lifted and lowered to different operating locations.

9. The invention according to claim 8, and wherein said interconnecting means further comprises a pair of pendular arms supporting said infeed conveyor intermediate its end, and means for adjusting the position of said arms to lift and lower the infeed conveyor.

10. The invention according to claim 7, and said interconnecting means comprising an element mounted on said infeed conveyor and engaging said upfeed conveyor for tilting said upfeed conveyor about its axis of pivot toward and away from said infeed conveyor.

11. A conveying system comprising an infeed conveyor having a discharge end and an upfeed conveyor disposed in receiving relation thereto, means mounting said upfeed conveyor for pivotal movement about a generally horizontal axis, means for guiding the infeed conveyor upwardly and downwardly and to and from with respect to the upfeed conveyor, and means operatively interconnecting said conveyors for correlatively moving said upfeed conveyor in predetermined adjusted positions to selected positions of said infeed conveyor for maintaining a preadjusted relationship therebetween upon repositioning of the infeed conveyor, and said means for guiding said infeed conveyor in a predetermined path being disposed at the discharge end thereof, and means for lifting and lowering said infeed conveyor, and means for supporting said infeed conveyor on an inclined plane and effecting movement thereof toward and away from said upfeed conveyor.

12. A first conveying means for supporting stack items arranged edgewise in a stack for movement sidewise in a discharge direction toward one end, second conveying means disposed athwart said one end of the first conveying means and providing an item deposit area in opposition to the end of the stack and operative to peel off the endmost item sequentially from the stack, means pivotally supporting said second conveying means on an axis transverse to the delivery direction of items by said first conveying means, means adjustably mounting said second conveying means for displacement relative to said deposit area for increasing or reducing the size of said deposit area in conformance to the size of said stack items to be delivered thereto, and means for adjustably interlocking said first and second conveying means for repositioning said second conveying means in response to repositioning of said first conveying means for obtaining proper delivery of items therefrom, and said second conveying means comprising a conveyor assembly and means slidably supporting said conveyor assembly along surfaces inclined toward said second conveying means for biasing said second conveying means toward the first conveying means.

13. A roller assembly comprising a hub, wedge roller clutch means within the hub for mounting on an associated shaft, a first sleeve tightly fitted about the hub for rotation therewith and having an inturned flange axially spaced from and opposing an adjacent end of the hub, a roller mounted on the first sleeve, a flexible plastic extension sleeve for mounting on the shaft having an outturned flange interposed between said inturned flange and said opposing end of the hub, and means for securing the extension sleeve to said shaft for rotation therewith, said hub, first sleeve and roller being relatively rotatable with respect to said extension sleeve.

14. In a conveying system for moving individual items from a stack;

a conveyor having an intake end and a discharge end, means for moving an individual item from the intake end to the discharge end, said means comprising a series of parallel rollers including a first set of rollers disposed adjacent to said intake end and a second set of rollers disposed adjacent to said discharge end, shaft means mounting said rollers, means for simultaneously driving all of said rollers through respective shaft means in an item discharging direction for a predetermined period, means for thereafter stopping said shaft means for a certain period, overrunning clutch means connecting the rollers of said second set to respective shaft means permitting overrunning the respective shaft means during said certain period to permit the individual item to be withdrawn from said conveyor, and means for holding the rollers of the first set during said predetermined period from rotating in a delivery of drive thereto upon termination of drive thereto whereby said rollers of the first set act as drags in contact with successive items being presented thereto concurrently with the individual item being discharged from said second set of rollers.

15. A conveyor for sequentially removing endmost items from the end of a stack presented thereto, support means, a conveyor assembly comprising a plurality of parallel shafts rotatably mounted on said support means, and including conveyor rollers mounted on said shafts for engagement with a side of the endmost item, overrunning clutch means interposed between said shafts and respective rollers, said conveying assembly having a delivery end, means for driving the shafts in a delivery directions and for stopping said shafts, means for supporting a part of said stock comprising a portion of said assembly at said delivery end having said clutch means arranged to overrun the respective shafts to permit rotation of the roller thereon and, removal of the endmost item upon stopping of the shafts, and means for supporting the remainder of the stack comprising another portion of said assembly having the rollers mounted on the respective shafts holding them from rotating with said rollers at said delivery end in said delivery direction upon stopping of the respective shafts and engaging a portion of each successive item to prevent removal thereof with a preceding item.

16. A conveyor having a spine elongated lengthwise of the conveyor, a plurality of free ended parallel transverse shafts rotatably mounted on said spine, drive transmitting means within said spine drivingly interconnecting the shafts, and rollers being sleeved on said shafts and constituting a conveyor bed, said rollers being removable from said shafts off their free ends and mountable thereon over said free ends, and one way drive means connecting certain rollers with their associated shaft, certain of said rollers being mounted through said drive means to rotate in one direction with its associated shaft and to overrun the shaft upon stopping of the shaft and others being mounted on their associated shafts to rotate therewith and to stop with the associated shafts upon stopping thereof.

17. A conveyor for sequentially removing endmost individual items from a stack presented thereto, support means, a conveying assembly comprising a plurality of parallel shafts rotatably mounted on said support means, said assembly including conveyor rollers mounted on said shafts for engagement with a side of the endmost item, said conveying means having a delivery end, means for driving said shafts with the rollers thereon in a delivery direction toward said delivery end during a predetermined period and for stopping said shafts after said period, overrunning clutch means connecting certain of said shafts adjacent to said delivery end of the conveyor with their respective rollers mounted thereon for accommodating their rotation in a delivery direction after their respective shafts having stopped whereby to facilitate withdrawal of the endmost item engaged thereby from between the conveyor and the stack, and means connecting other of said rollers with their respective shafts for stopping therewith after said period for engaging said other of said rollers with a portion of the next succeeding item and restraining its discharge during withdrawal of the preceding endmost item.

* * * * *